US006396384B1

(12) United States Patent
Blok et al.

(10) Patent No.: US 6,396,384 B1
(45) Date of Patent: May 28, 2002

(54) CONDUCTIVE POLYMER COMPOSITIONS CONTAINING PERHYDROTRIPHENYLENE

(75) Inventors: Edward J. Blok, Wadsworth; Blase S. Amadio, Mansfield, both of OH (US)

(73) Assignee: Therm-O-Disc, Incorporated, Mansfield, OH (US)

( * ) Notice: Subject to any disclaimer, the term of this patent is extended or adjusted under 35 U.S.C. 154(b) by 78 days.

(21) Appl. No.: 09/685,371

(22) Filed: Oct. 10, 2000

(51) Int. Cl.[7] ..... H01C 7/10
(52) U.S. Cl. ..... 338/22 R; 252/511
(58) Field of Search ..... 338/22 R, 22 SD; 252/510, 511

(56) References Cited

U.S. PATENT DOCUMENTS 5,580,493 A 12/1996 Chu et al.
5,582,770 A 12/1996 Chu et al.
5,837,164 A 11/1998 Zhao
5,985,182 A 11/1999 Zhao

FOREIGN PATENT DOCUMENTS

JP 58-211426 * 12/1983

* cited by examiner

*Primary Examiner*—Karl D. Easthom
(74) *Attorney, Agent, or Firm*—Harness, Dickey & Pierce, P.L.C.

(57) ABSTRACT

The invention provides polymeric PTC compositions and electrical PTC devices with high voltage capability and high switch temperatures. The polymeric PTC composition specifically includes perhydrotriphenylene as an organic polymer component which, when blended with a crystalline or semi-crystalline organic polymer component such as polyethylene, gives rise to a composition having a melting point, Tm of up to about 181° C.

38 Claims, 1 Drawing Sheet

CONDUCTIVE POLYMER COMPOSITIONS CONTAINING PERHYDROTRIPHENYLENE

BACKGROUND OF THE INVENTION

The invention relates generally to polymeric positive temperature coefficient (PTC) compositions and electrical PTC devices. In particular, the invention relates to polymeric PTC compositions containing perhydrotriphenylene which are suitable for high temperature applications.

Electrical devices comprising conductive polymeric compositions that exhibit a PTC effect are well known in electronic industries and have many applications, including their use as constant temperature heaters, thermal sensors, low power circuit protectors and over current regulators for appliances and live voltage applications, by way of non-limiting example. A typical conductive polymeric PTC composition comprises a matrix of a crystalline or semi-crystalline thermoplastic resin (e.g., polyethylene) or an amorphous thermoset resin (e.g., epoxy resin) containing a dispersion of a conductive filler, such as carbon black, graphite chopped fibers, nickel particles or silver flakes. Some compositions additionally contain flame retardants, stabilizers, antioxidants, antiozonants, accelerators, pigments, foaming agents, crosslinking agents, dispersing agents and inert fillers.

At a low temperature (e.g. room temperature), the polymeric PTC composition has a contiguous structure that provides a conducting path for an electrical current, presenting low resistivity. However, when a PTC device comprising the composition is heated or an over current causes the device to self-heat to a transition temperature, a less ordered polymer structure resulting from a large thermal expansion presents a high resistivity. In electrical PTC devices, for example, this high resistivity limits the load current, leading to circuit shut off. In the context of this invention $T_s$ is used to denote the "switching" temperature at which the "PTC effect" (a rapid increase in resistivity) takes place. The sharpness of the resistivity change as plotted on a resistance versus temperature curve is denoted as "squareness", i.e., the more vertical the curve at the $T_s$, the smaller is the temperature range over which the resistivity changes from the low to the maximum values. When the device is cooled to the low temperature value, the resistivity will theoretically return to its previous value. However, in practice, the low-temperature resistivity of the polymeric PTC composition may progressively increase as the number of low-high-low temperature cycles increases, an electrical instability effect known as "ratcheting".

Crosslinking of a conductive polymer by chemicals or irradiation, or the addition of inert fillers or organic additives may be employed to improve electrical stability.

In the preparation of the conductive PTC polymeric compositions, the processing temperature often exceeds the melting point of the polymer by 20° C. or more, with the result that the polymers may undergo some decomposition or oxidation during the forming process. In addition, some devices exhibit thermal instability at high temperatures and/or high voltages that may result in aging of the polymer. Thus, inert fillers and/or antioxidants, etc. may be employed to provide thermal stability. Among the known inert fillers employed in PTC polymeric compositions are polymeric powders such as polytetrafluoroethylene (e.g., Teflon™ powder), polyethylene and other plastic powders, fumed silica, calcium carbonate, magnesium carbonate, aluminum hydroxide, kaolin, talc, chopped glass or continuous glass, fiberglass and fibers such as Kelvar™ polyaramide fiber (available from DuPont) among others. According to U.S. Pat. No. 4,833,305 by Machino et al., the fibers employed preferably have an aspect ratio of approximately 100 to 3500, a diameter of at least approximately 0.05 microns and a length of at least approximately 20 microns.

Polymeric PTC materials have found a variety of applications, such as self-regulating heaters and self-resettable sensors to protect equipment from damage caused by over-temperature or over-current surge. For circuit protection, the polymeric PTC devices are normally required to have the ability to self-reset, to have a low resistivity at 25° C. (10 Ωcm or less), and to have a moderately high PTC effect ($10^3$ or higher) in order to withstand a direct current (DC) voltage of 16 to 20 volts. Polyolefins, particularly polyethylene (PE)-based conductive materials, have been widely explored and employed in these low DC voltage applications.

Polymeric PTC sensor devices that are capable of operating at much higher voltages, such as the 110 to 240 alternating current voltages (VAC) ("Line" voltages) present in AC electrical lines. Such high voltage capacity polymeric PTC devices would be useful to protect the motors of household appliances, such as dishwashers, washers, refrigerators and the like.

In view of the foregoing, there is a need for the development of polymeric PTC compositions and devices comprising them that exhibit a high PTC effect, have a low initial resistivity, that exhibit substantial electrical and thermal stability, that are capable of use over a broad voltage range, i.e., from about 6 volts to about 300 volts and are useful in high temperature applications.

SUMMARY OF THE INVENTION

The invention provides polymeric PTC compositions and electrical PTC devices having relatively high temperature capabilities and increased voltage capabilities while maintaining a low RT resistance. In particular, the PTC compositions are useful in the manufacture of PTC devices which are operable at high ambient operating temperatures while demonstrating a high PTC effect (the resistivity at the $T_s$ is at least $10^3$ times the resistivity at 25° C.) and a low initial resistivity at 25° C. (preferably 10 Ωcm or less, more preferably 5 mΩ or less). The electrical PTC devices comprising these polymeric PTC compositions preferably have a resistance at 25° C. of 500 mΩ or less (preferably about 5 mΩ to about 500 mΩ, more preferably about 7.5 mΩ to about 200 mΩ, typically about 10 mΩ to about 100 mΩ) with a desirable design geometry.

The electrical PTC devices of the present invention have switch temperatures up to 181° C., which is approximately 50° C. higher than other polyethylene based PTC devices, particularly those exhibiting increased voltage capabilities and a low RT resistance.

The polymeric PTC compositions of the invention, demonstrating the above characteristics, comprise an organic polymer component including perhydrotriphenylene, a particulate conductive filler, an inert filler and, optionally, an additive selected from the group consisting of inorganic stabilizers, flame retardants, antioxidants, antiozonants, accelerators, pigments, foaming agents, crosslinking agents and dispersing agents. The compositions may or may not be crosslinked to improve electrical stability before or after their use in the electrical PTC devices of the invention.

The electrical PTC devices of the invention have, for example, the high voltage capability to protect equipment operating on Line current voltages from over-heating and/or over-current surges. The devices are particularly useful as self-resetting sensors for AC motors, such as those of household appliances, such as dishwashers, washers, refrigerators and the like. Additionally, PTC compositions for use in low voltage devices such as batteries, actuators, disk drives, test equipment and automotive applications are also described below.

DETAILED DESCRIPTION OF THE INVENTION

Figure 1:
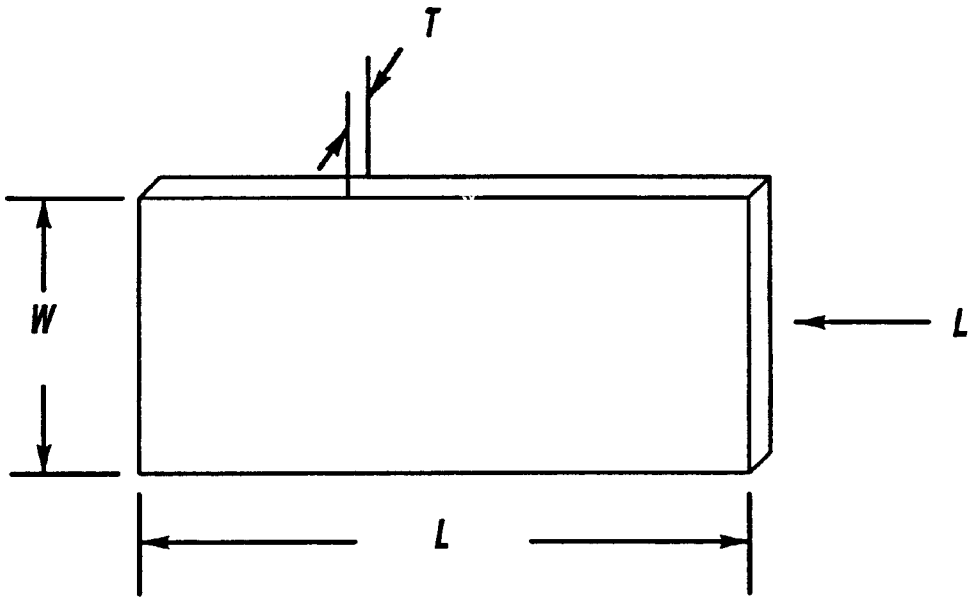
FIG. 1 is a schematic illustration of a PTC chip comprising the polymeric PTC composition of the invention sandwiched between two metal electrodes.

The PTC polymeric composition of the present invention comprises an organic polymer component including perhydrotriphenylene, a particulate conductive filler, an inert filler and, optionally, an additive selected from the group consisting of flame retardants, stabilizers, antioxidants, antiozonants, accelerators, pigments, foaming agents, crosslinking agents, coupling agents, co-agents and dispersing agents. While not specifically limited to high voltage applications, for purposes of conveying the concepts of the present invention, PTC devices employing the novel PTC polymeric compositions will generally be described with reference to high voltage embodiments. The criteria for a high voltage capacity polymeric composition are (i) a high PTC effect, (ii) a low initial resistivity at 25° C., and (iii) the capability of withstanding a voltage of up to 240 volts (AC) or greater while maintaining electrical and thermal stability. As used herein, the term "high PTC effect" refers to a composition resistivity at the $T_s$ that is at least $10^3$ times the composition resistivity at room temperature (for convenience, 25° C.). There is no particular requirement as to the temperature at which the composition switches to its higher resistivity state. That is, the magnitude of the PTC effect has been found to be more important than the $T_s$.

As used here, the term "low initial resistivity" refers to an initial composition resistivity at 25° C. of 100 Ωcm or less, preferably 10 Ωcm or less, more preferably 5 Ωcm or less, especially 2 Ωcm or less, thus providing for a PTC device having a low resistance at 25° C. of about 500 mΩ or less, preferably about 5 mΩ to 500 mΩ, more preferably about 7.5 mΩ to about 10 mΩ to about 200 mΩ, typically about 10 mΩ to about 100 rnΩ, with an appropriate geometric design and size, as discussed further below.

The organic polymer component includes a compound known as perhydrotriphenylene which has a melting point temperature of about 128° C. The perhydrotriphenylene should preferably be used in combination with one or more other organic compounds such as high molecular weight polyethylenes (181.0° C.), low molecular weight polyethylene (165.0° C)., cis-1,4-polybutadiene (158.0° C.), trans-1, 4-polybutadiene (183.0° C.), polyoxyethylene glycol (139.0° C.), m-heptane (127.0° C.), palmitic acid (157.0° C.), stearic acid (158.0° C.), undecylenic acid (148.0° C.), adipic acid (165.0° C.), azelaic acid (154.0° C.) and cetyl alcohol (148.0° C.). The melting point temperature of blends of the perhydrotriphenylene and compound are noted in parentheses.

It is known that the $T_s$ of a conductive polymeric composition is generally slightly below the melting point ($T_m$) of the polymeric matrix. If the thermal expansion coefficient of the polymer is sufficiently high near the $T_m$, a high PTC effect may occur. Further, it is known that the greater the crystallinity of the polymer, the smaller the temperature range over which the rapid rise in resistivity occurs. Thus, crystalline polymers exhibit more "squareness", or electrical stability, in a resistivity versus temperature curve.

A preferred blend of perhydrotriphenylene and at least one other organic polymer component would exhibit a crystallinity of at least 10% and preferably in the range of 40% to 98%. In order to achieve a composition with a high PTC effect, it is preferable that the polymer has a melting point ($T_m$) in the temperature range of 100° C. to 250° C. Preferably, the polymer substantially withstands decomposition at a processing temperature that is at least 20° C. and preferably less than 120° C. above the $T_m$.

When employed, the crystalline or semi-crystalline polymer component of the conductive polymeric composition of the invention may also comprise a polymer blend containing, in addition to the first polymer, between about 0.5 to 50.0% of a second crystalline or semi-crystalline polymer based on the total polymeric component. The second crystalline or semi-crystalline polymer is preferably a polyolefin-based or polyester-based thermoplastic elastomer. Preferably the second polymer has a melting point ($T_m$) in the temperature range of 60° C. to 300° C.

When blends of perhydrotriphenylene and at least one other organic polymer are employed, the blend will generally include a weight ratio of between about 50:1 to about 1:50 perhydrotriphenylene to the at least one crystalline or semi-crystalline polymer.

The particulate electrically conducive filler may comprise carbon black, graphite, metal particles, or a combination of these. Metal particles may include, but are not limited to, nickel particles, silver flakes, or particles of tungsten, molybdenum, gold platinum, iron, aluminum, copper, tantalum, zinc, cobalt, chromium, lead, titanium, tin alloys or mixtures of the foregoing. Such metal fillers for use in conductive polymeric compositions are known in the art.

It is preferred to use medium to high structured carbon black with a relatively low resistivity. Such preferred carbon blacks generally have a particle size measured by iodine absorption 14 to 50 (g/kgm) and a structure of 40 to 180 ($cm^3$/100 gm) determined by dibutyl phthalate (DBP) absorption. Examples of useful carbon blacks are Statex N550, N630, N650, N660, Furnex N762 and N774, all available from Columbian Chemicals Company. The particulate conductive filler ranges from 15.0 phr to 250.0 phr and, preferably, from 60.0 phr to 180.0 phr.

The inert filler component comprises inert fibers such as continuous and chopped fibers including, by way of non-limiting example, fiberglass and polyamide fibers such as Kevlar (available from DuPont). Such fibers may be randomly oriented or may be specifically oriented to improve the anisotropic behavior. The total amount of fibers employed will generally range from between about 0.25 phr to about 50.0 phr and, preferably, from about 0.5 phr to about 10.0 phr. It should be understood that "phr" means parts per 100.0 parts of the organic polymer component.

Additional inert fillers may also be employed including, for example, amorphous polymeric powders such as silicon, nylons, fumed silica, calcium carbonate, magnesium carbonate, aluminum hydroxide, kaolin clay, barium sulphate, talc, chopped glass or continuous glass, among others. The total inert filler component ranges from 0.25 phr to about 100.0 phr and, preferably, from 0.5 phr to about 15.0 phr.

In addition to the organic polymeric component including perhydrotriphenylene, the particulate conductive filler and the inert filler, the conductive polymeric composition may additionally comprise additives to enhance electrical, mechanical, and thermal stability. Suitable inorganic additives for electrical and mechanical stability include metal oxides, such as magnesium oxide, zinc oxide, aluminum oxide, titanium oxide, or other materials, such as calcium carbonate, magnesium carbonate, alumina trihydrate, and magnesium hydroxide, or mixtures of any of the foregoing. Organic antioxidants may be optionally added to the composition to increase the thermal stability. In most cases, these are either phenol or aromatic amine type heat stabilizers, such as N,N'-1,6-hexanediylbis (3,5-bis (1,1-dimethylethyl)-4-hydroxy-benzene) propanamide (Irganox-1098, available from Ciba-Geigy Corp., Hawthorne, N.Y.), N-stearoyl-4-aminophenol, N-lauroyl-4-aminophenol, and polymerized 1,2-dihydro-2,2,4-trimethyl quinoline. The proportion by weight of the organic antioxidant agent in the composition may range from 0.1 phr to 15.0 phr and, preferably 0.5 phr to 7.5 phr. The conductive polymeric composition may also comprise other inert fillers, nucleating agents, antiozonants, fire retardants, stabilizers, dispersing agents, crosslinking agents, or other components.

Figure 2:
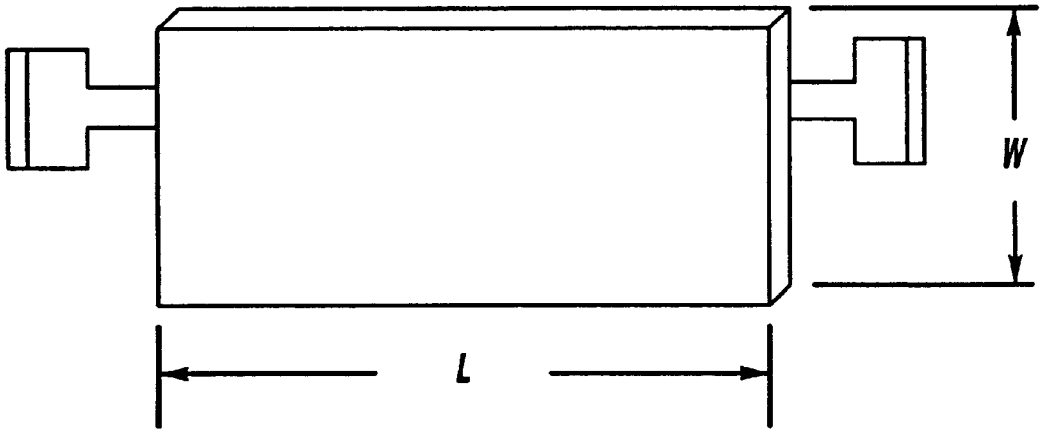
FIG. 2 is a schematic illustration of an embodiment of a PTC device according to the invention, comprising the PTC chip of FIG. 1 with two attached terminals.

To enhance electrical stability, the conductive polymer composition may be crosslinked by chemicals, such as organic peroxide compounds, or by irradiation, such as by a high energy electron beam, ultraviolet radiation or by gamma radiation, as known in the art. Although crosslinking is dependent on the polymeric components and the application, normal crosslinking levels are equivalent to that achieved by an irradiation dose in the range of 1 to 150 Mrads, preferably 2.5 to 20 Mrads, e.g., 10.0 Mrads. If crosslinking is by irradiation, the composition may be crosslinked before or after attachment of the electrodes. In an embodiment of the invention, the high temperature PTC device of the invention comprises a PTC "chip" 1 illustrated in FIG. 1 and electrical terminals 12 and 14, as described below and schematically illustrated in FIG. 2. As shown in FIG. 1, the PTC chip 1 comprises the conductive polymeric composition 2 of the invention sandwiched between metal electrodes 3. The electrodes 3 and the PTC composition 2 are preferably arranged so that the current flows through the PTC composition over an area LxW of the chip 1 that has a thickness, T, such that W/T is at least 2, preferably at least 5, especially at least 10. The electrical resistance of the chip or PTC device also depends on the thickness and the dimensions W and L, and T may be varied in order to achieve a preferable resistance, described below. For example, a typical PTC chip generally has a thickness of 0.05 to 5 millimeters (mm), preferably 0.1 to 2.0 mm, and more preferably, 0.2 to 1.0 mm. The general shape of the chip/device may be that of the illustrated embodiment or may be of any shape with dimensions that achieve the preferred resistance.

It is generally preferred to use two planar electrodes of the same area which are placed opposite to each other on either side of a flat PTC polymeric composition of constant thickness. The material for the electrodes is not specially limited, and can be selected from silver, copper, nickel, aluminum, gold and the like. The material can also be selected from combinations of these metals, nickel-plated copper, tin-plated copper, and the like. The electrodes are preferably used in a sheet form. The thickness of the sheet is generally less than 1 mm, preferably less than 0.5 mm, and more preferably less than 0.1 mm.

The high temperature PTC device manufactured by compression molding or by extrusion/lamination, as described below, and containing a crosslinked composition demonstrates electrical stability. As termed herein, a device demonstrating "electrical stability" has an initial resistance $R_o$ at 25° C. and a resistance $R_x$ at 25° C. after X cycles to the switching temperature and back to 25° C., wherein the value of the ratio $(R_x-R_o)/R_o$, which is the ratio of the increase in resistance after X temperature excursion, to the initial resistance at 25° C. Generally speaking, the lower the valve, the more stable the composition.

The conductive polymeric compositions of the invention are prepared by methods known in the art. In general, the organic polymer component including perhydrotriphenylene, the conductive filler, the inert filler and additives (if employed) are compounded at a temperature that is at least 20° C. higher, but no more than 120° C. higher, than the melting temperature of the organic polymer component. The compounding temperature is determined by the flow property of the compounds. In general, the higher the filler content (e.g., carbon black), the higher is the temperature used for compounding. After compounding, the homogeneous composition may be obtained in any form, such as pellets. The composition is then subjected to a hot-press or extrusion/lamination process and transformed into a thin PTC sheet.

To manufacture PTC sheets by compression molding, homogeneous pellets of the PTC composition are placed in a molder and covered with metal foil (electrodes) on top and bottom. The composition and metal foil sandwich is then laminated into a PTC sheet under pressure. The compression molding processing parameters are variable and depend upon the PTC composition. For example, the higher the filler (e.g., carbon black) content, the higher is the processing temperature and/or the higher is the pressure used and/or the longer is the processing time. By controlling the parameters of temperature, pressure and time, different sheet materials with various thicknesses may be obtained.

To manufacture PTC sheets by extrusion, process parameters such as the temperature profile, head pressure, RPM, and the extruder screw design are important in controlling the PTC properties of resulting PTC sheet. Generally, the higher the filler content, the higher is the processing temperature used to maintain the head pressure. A screw with a straight-through design is preferred in the manufacture of PTC sheets. Because this screw design provides low shear force and mechanical energy during the process, the possibility of breaking down the carbon black aggregates is reduced, resulting in PTC sheets having low resistivity. The thickness of the extruded sheets is generally controlled by the die gap and the gap between the laminator rollers. During the extrusion process, metallic electrodes in the form of metal foil covering both the top and bottom of a layer of the polymer compound, are laminated to the composition. Compositions that contain nylon-12 (or nylon-11), carbon black, magnesium oxide, and the like, in varying proportions, are processed by extrusion/lamination.

PTC sheets obtained, e.g., by compression molding or extrusion, are then cut to obtain PTC chips having predetermined dimensions and comprising the conductive polymeric composition sandwiched between the metal electrodes. The composition may be crosslinked, such as by irradiation, if desired, prior to cutting of the sheets into PTC chips. Electrical terminals are then soldered to each individual chip to form PTC electrical devices.

A suitable solder provides good bonding between the terminal and the chip at 25° C. and maintains a good bonding at the switching temperature of the device. The bonding is characterized by the shear strength. A shear strength of 250 Kg or more at 25° C. for a 2×1 $cm^2$ PTC device is generally acceptable. The solder is also required to show a good flow property at its melting temperature to homogeneously cover the area of the device dimension. The solder used generally has a melting temperature of 10° C., preferably 20° C. above the switching temperature of the device.

While the invention has been described herein with reference to the preferred embodiments, it is to be understood that it is not intended to limit the invention to the specific forms disclosed. On the contrary, it is intended to cover all modifications and alternative forms falling within the spirit and scope of the invention.

We claim:

1. A polymeric PTC composition comprising an organic polymer component including perhydrotriphenylene, a conductive filler and an inert filler.

2. The composition of claim 1, wherein the organic polymer component includes a blend of perhydrotriphenylene and at least one crystalline or semi-crystalline polymer.

3. The composition of claim 2 wherein said at least one crystalline or semi-crystalline polymer is selected from the group consisting essentially of high molecular weight polyethylenes, low molecular weight polyethylenes, cis-1, 4-polybutadiene, trans-1,4-polybutadiene, polyoxyethylene glycol, m-heptane, palmitic acid, stearic acid, undeilenic acid, adipic acid, azelaic acid and cetyl alcohol.

4. The composition of claim 2 wherein said blend includes a weight ratio of between about 50:1 to about 1:50 perhydrotriphenylene to said at least one crystalline or semi-crystalline polymer.

5. The composition of claim 2 wherein the blend has a melting point, $T_m$ of up to about 181° C.

6. The composition of claim 2 wherein the melting point, $T_m$ of the blend is at least 10° C. higher than the melting point, $T_m$ of either of said perhydrotriphenylene or said crystalline or semi-crystalline polymer.

7. The composition of claim 1 wherein the second polymer has a melting temperature $T_m$ of about 100° C. to about 250° C.

8. The composition of claim 1, having a resistivity at 25° C. of 100 Ωcm or less.

9. The composition of claim 1 wherein said inert filler is present in an amount of between about 0.25 phr to 100.0 phr.

10. The composition of claim 1 wherein said inert filler is present in an amount of between about 0.5 phr to 15.0 phr.

11. The composition of claim 1 wherein the conductive filler is selected from the group consisting of carbon black, graphite, metal particles, and mixtures thereof.

12. The composition of claim 10 wherein the metal particles are selected from the group consisting of nickel particles, silver flakes, or particles of tungsten, molybdenum, gold, platinum, iron, aluminum, copper, tantalum, zinc, cobalt, chromium, lead, titanium, tin alloys, and mixtures thereof.

13. The composition of claim I wherein the inorganic stabilizers are selected from the group consisting of magnesium oxide, zinc oxide, aluminum oxide, titanium oxide, calcium carbonate, magnesium carbonate, alumina trihydrate, magnesium hydroxide, and mixtures thereof.

14. The composition of claim 1 wherein the antioxidant comprises a phenol or an aromatic amine.

15. The composition of claim 14, wherein the antioxidant is selected from the group consisting of N,N'-1,6-hexanediylbis (3,5-bis (1,1-dimethylethyl)-4-hydroxybenzene) propanamide, (N-stearoyl-4-aminophenol, N-lauroyl-4-aminophenol, polymerized 1,2-dihydro-2,2,4-trimethyl quinoline, and mixtures thereof.

16. The composition of claim 1 wherein said conductive filler is present in an amount of between about 15.0 phr to 250.0 phr.

17. The composition of claim 1 wherein said conductive filler is present in an amount of between about 60.0 phr to 180.0 phr.

18. The composition of claim 1, wherein the polymeric PTC composition is crosslinked with the aid of a chemical agent or by irradiation.

19. The composition of claim 1 further comprising at least one additive selected from the group consisting of inert fillers, flame retardants, stabilizers, antioxidants, antiozonants, accelerators, pigments, foaming agents, crosslinking agents and dispersing agents.

20. An electrical device which exhibits PTC behavior, comprising:

(a) a conductive polymeric composition that comprises an organic polymer component including perhydrotriphenylene and a conductive filler, the composition having a resistivity at 25° C. of 100 Ωcm or less and a resistivity at its switching temperature that is at least $10^3$ times the resistivity at 25° C.; and (b) at least two electrodes which are in electrical contact with the conductive polymeric composition to allow a DC or an AC current to pass through the composition under an applied voltage, wherein the device has a resistance at 25° C. of 500 mΩ or less with a desirable design geometry.

21. The device of claim 20 wherein the device has a resistance at 25° C. of about 5.0 mΩ to about 400 mΩ.

22. The device of claim 21 wherein the device has a resistance at 25° C. of about 10 mΩ to about 100 mΩ.

23. The device of claim 20 wherein the organic polymer component includes a blend of perhydrotriphenylene and at least one crystalline or semi-crystalline polymer.

24. The composition of claim 20 wherein said blend includes a weight ratio of between about 50:1 to about 1:50 perhydrotriphenylene to said at least one crystalline or semi-crystalline polymer.

25. The composition of claim 20 wherein said at least one crystalline or semi-crystalline polymer is selected from the group consisting essentially of high molecular weight polyethylenes, low molecular weight polyethylenes, cis-1, 4-polybutadiene, trans-1,4-polybutadiene, polyoxyethylene glycol, m-heptane, palmitic acid, stearic acid, undeilenic acid, adipic acid, azelaic acid and cetyl alcohol.

26. The composition of claim 23 wherein the second polymer has a melting point $T_m$ of up to about 181° C.

27. The composition of claim 22 wherein the crystalline or semi-crystalline polymer has a melting temperature $T_m$ of about 100° C. to about 250° C.

28. The composition of claim 23 wherein the melting point, $T_m$ of the blend is at least 10° C. higher than the melting point, $T_m$ of either of said perhydrotriphenylene or said crystalline or semi-crystalline polymers.

29. The composition of claim 20 wherein said inert filler is present in an amount of between about 0.25 phr to 100.0 phr.

30. The composition of claim 20 wherein said inert filler is present in an amount of between about 0.5 phr to 15.0 phr.

31. The composition of claim 20 wherein the conductive filler is selected from the group consisting of carbon black, graphite, metal particles, and mixtures thereof.

32. The composition of claim 29 wherein the metal particles are selected from the group consisting of nickel particles, silver flakes, or particles of tungsten, molybdenum, gold, platinum, iron, aluminum, copper, tantalum, zinc, cobalt, chromium, lead, titanium, tin alloys, and mixtures thereof.

33. The composition of claim 20 wherein the inorganic stabilizers are selected from the group consisting of magnesium oxide, zinc oxide, aluminum oxide, titanium oxide, calcium carbonate, magnesium carbonate, alumina trihydrate, magnesium hydroxide, and mixtures thereof.

34. The composition of claim 20, wherein the antioxidant is selected from the group consisting of N,N'-1,6-hexanediylbis (3,5-bis (1,1-dimethylethyl)-4-hydroxybenzene) propanamide, (N-stearoyl-4-aminophenol, N-lauroyl-4-aminophenol, polymerized 1,2-dihydro-2,2,4-trimethyl quinoline, and mixtures thereof.

35. The composition of claim 20 wherein said conductive filler is present in an amount of between about 15.0 phr to 250.0 phr.

36. The composition of claim 20 wherein said conductive filler is present in an amount of between about 60.0 phr to 180.0 phr.

37. The composition of claim 20 wherein the polymeric PTC composition is crosslinked with the aid of a chemical agent or by irradiation.

38. The composition of claim 20 further comprising at least one additive selected from the group consisting of inert fillers, flame retardants, stabilizers, antioxidants, antiozonants, accelerators, pigments, foaming agents, crosslinking agents and dispersing agents.

* * * * *